US008341901B2

(12) United States Patent
Loyd

(10) Patent No.: US 8,341,901 B2
(45) **Date of Patent: *Jan. 1, 2013**

(54) CURTAIN WALL SYSTEM AND METHOD

(75) Inventor: Stephen N. Loyd, Dallas, TX (US)

(73) Assignee: Stephen N. Loyd Irrovocable Family Trust, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/290,553

(22) Filed: Nov. 7, 2011

(65) Prior Publication Data

US 2012/0137609 A1 Jun. 7, 2012

Related U.S. Application Data

(63) Continuation of application No. 12/124,649, filed on May 21, 2008, now Pat. No. 8,051,623, which is a continuation-in-part of application No. 11/074,086, filed on Mar. 7, 2005, now abandoned.

(60) Provisional application No. 60/565,445, filed on Apr. 26, 2004.

(51) Int. Cl.
*E04B 2/88* (2006.01)
*E04G 23/00* (2006.01)

(52) U.S. Cl. ..... 52/235; 52/489.1; 52/586.2; 52/769; 52/747.1

(58) Field of Classification Search ..... 52/235, 52/508, 509, 513, 136, 137, 139, 489.1, 506.06, 52/586.2, 747.1, 747.11, 483.1, 489.2, 769, 52/773, 511

See application file for complete search history.

(56) References Cited

U.S. PATENT DOCUMENTS

| | | | |
|---|---|---|---|
| 2,245,785 | A | 6/1941 | Jentzer, Jr. |
| 3,640,043 | A | 2/1972 | Querfeld et al. |
| 3,786,605 | A | 1/1974 | Winfrey |
| 4,506,482 | A | 3/1985 | Pracht et al. |
| 5,265,396 | A | 11/1993 | Amimoto |
| 5,301,484 | A | 4/1994 | Jansson |
| 5,313,760 | A | 5/1994 | Tojo |
| 5,473,851 | A | 12/1995 | Northrup, Jr. |
| 6,098,364 | A | 8/2000 | Liu |
| 6,170,214 | B1 | 1/2001 | Treister et al. |
| 6,202,377 | B1 | 3/2001 | Krieger |
| 6,792,727 | B2 | 9/2004 | Krieger |
| 2003/0150179 | A1 | 8/2003 | Moreno |
| 2005/0246983 | A1 | 11/2005 | Loyd |

OTHER PUBLICATIONS

*Mexican Patent Office*; OA and English Translation Re: Examination Results; Application PA/a/2006/002573, Ref. 205/025561; Case: 079536.0104; U.S. Appl. No. 11/074,086.

*Canadian Intellectual Patent Office*; OA Communication, Application 2,538,441, Ref. file No. 60622, (3 pgs), Aug. 31, 2012.

*Primary Examiner* — Robert Canfield
*Assistant Examiner* — Jessie Fonseca
(74) *Attorney, Agent, or Firm* — Baker Botts L.L.P.

(57) ABSTRACT

A method includes substantially filling with joint sealant first and second kerfs in upper and lower ends, respectively, of a curtain wall member. A locating-and-retaining member of a latching member is embedded in the first kerf's sealant. A receiving-and-retaining member of a first bracket is embedded in the second kerf's sealant, the wall member initially extending upwardly and angularly outwardly relative to the first bracket. The wall member is pivoted inwardly such that an end of a nominally horizontally-disposed portion of the latching member slides along a lower surface of a supporting member of a second bracket causing the latching member to rotate downwardly, compressing foam tape beneath the horizontally-disposed portion. The end of the latching member moves past a locking member until a latch comes into latching engagement with the locking member, the foam tape decompressing and maintaining the latching member in engagement with the lower surface.

20 Claims, 10 Drawing Sheets

CURTAIN WALL SYSTEM AND METHOD

CLAIM OF PRIORITY

This application is a continuation under 35 U.S.C. §120 of and claims priority to U.S. patent application Ser. No. 12/124,647 filed May 21, 2008, which will issue as U.S. Pat. No. 8,051,623 on Nov. 8, 2011, the entire contents of which are incorporated herein by reference, which is a continuation-in-part of U.S. patent application Ser. No. 11/074,086, filed Mar. 7, 2005, now abandoned, the entire contents of which are incorporated herein by reference, which claims priority of U.S. Provisional Patent Application No. 60/565,445, filed Apr. 26, 2004, now expired, the entire contents of which are incorporated herein by reference.

DETAILED DESCRIPTION

Figure 1:
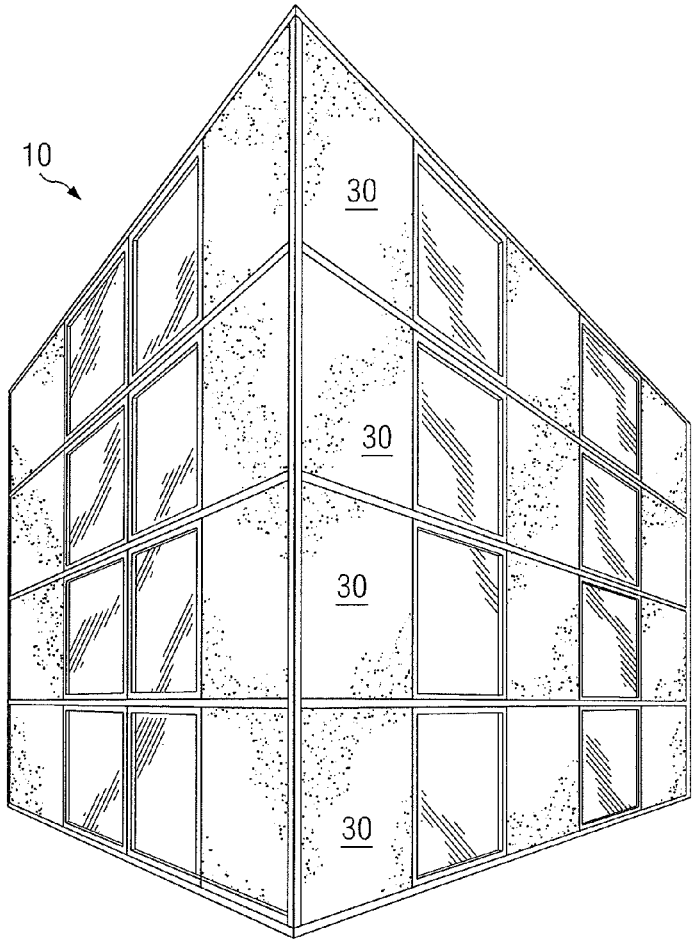
FIG. 1 is an environmental view illustrating a curtain wall system installed in accordance with a first embodiment of the present invention.
Figure 2:
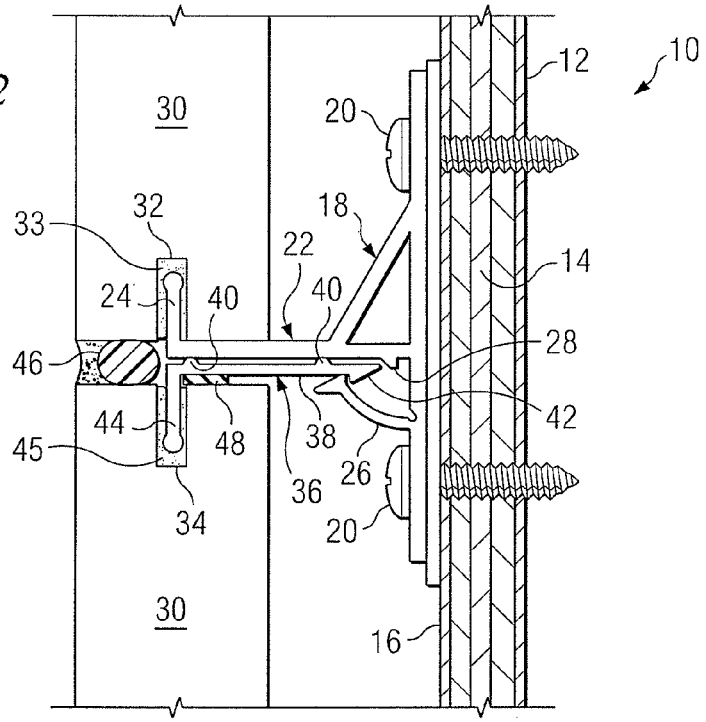
FIG. 2 is an illustration of a curtain wall constructed in accordance with the first embodiment of the present invention.

Referring to FIGS. 1 and 2, there is shown a curtain wall 10 incorporating a first embodiment of the present invention. The curtain wall 10 is supported on a wall 12, which may be comprised of one or more layers of plywood 14. The wall may also comprise steel studs, concrete masonry units (CMOs), concrete, etc. Other construction techniques may be utilized in the fabrication of the wall 12 depending upon the requirements of particular applications of the present invention. The wall 12 may comprise an exterior wall of a building or other structure. In such instances the wall 12 may be provided with a weather proof exterior layer 16 which is fabricated in accordance with conventional techniques.

In accordance with the present invention a plurality of channels (brackets) 18 are secured to the wall 12 by suitable fasteners 20. The channels (brackets) 18 may be fabricated from aluminum; however, other materials may be utilized in the fabrication of the channels (brackets) 18 depending upon the requirements of particular applications of the present invention. A plurality of channels (brackets) 18 may be positioned adjacent to one another to define a curtain wall support structure which extends substantially the entire width of the wall 12. Alternatively, the channels (brackets) 18 may be positioned at spaced-apart locations along the width of the wall 12.

Each channel (bracket) 18 includes a curtain wall supporting member 22, which extends perpendicularly outwardly from the wall 12. A curtain wall receiving and retaining member 24 is located at the distal end of the curtain wall support member 22 and extends perpendicularly upwardly therefrom. The channel (bracket) 18 is further provided with a locking member 26 and a stop 28.

A plurality of curtain wall members 30 are formed from limestone or other materials. For example, the curtain wall members may be formed from granite, marble, terrazzo, etc. Each curtain wall member 30 has a kerf 32 formed in the lower end thereof and a kerf 34 formed in the upper end thereof.

Following installation, each curtain wall member 30 is supported by the supporting member 22 of the associated channel (bracket) 18, which is in turn secured to the wall 12 by the fasteners 20. The receiving and retaining member 24 of the channel (bracket) 18 is received in the kerf 32 of the curtain wall member 30, which is supported on the channel (bracket) 18. In this manner the curtain wall member 30 is located and positioned relative to the wall 12 by the channel (bracket) 18. A bed of silicone 33 surrounds and flexibly retains the receiving and retaining members 24.

In accordance with the present invention, latching members 36 are utilized in conjunction with the channel (bracket) 18. Each latching member 36 includes a horizontally disposed portion 38 which ultimately extends parallel to the supporting member 22 of the channel (bracket) 18. Knobs 40 formed on the horizontally disposed portion 38 of the latching member 36 maintain proper alignment between the horizontally disposed portion 38 and the supporting member 22.

The horizontally disposed portion 38 of the latching member 36 extends to an arrow-shaped latch 42 positioned for latching engagement with the locking member 26 of the channel (bracket) 18. The distal end of the latch 42 is positioned closely adjacent to and in alignment with the stop 28 of the channel (bracket) 18.

A locating and retaining member 44 is located at the opposite end of the horizontally disposed portion 38 of the latching member 36 and extends perpendicularly with respect thereto. The locating and retaining member 44 is received in the kerf 34 situated at the upper end of the corresponding curtain wall member 30 and is retained therein by a quantity of silicone 45 previously received therein. Once two adjoining wall members 30 are secured in place, an open cell backer rod 43 is inserted. Then joint sealant 46 is applied between the wall members 30 to seal against moisture penetration, to provide additional strength and stability to the wall members, and to provide a cushion allowing some movement by the wall members 30 due to wind load, foundation settlement, earthquakes, hurricanes, and the like.

Figure 3:
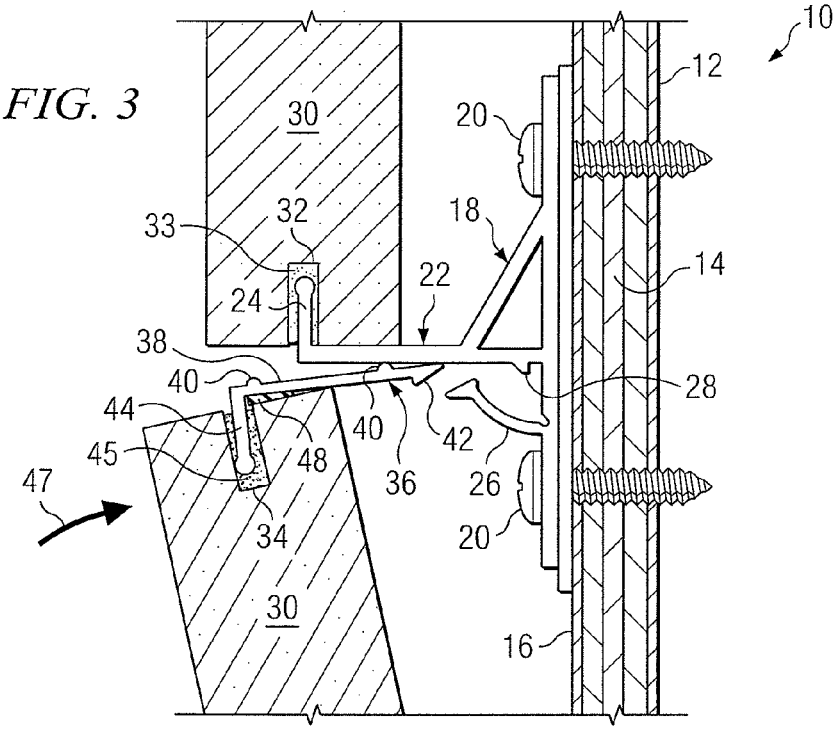
FIG. 3 is an illustration of the curtain wall installation method in accordance with the first embodiment of the present invention.

A method of curtain wall installation comprising a first embodiment of the present invention is illustrated in FIG. 3.

An upper curtain wall member 30 is first supported on a channel (bracket) 18 constructed in accordance with the present invention with the receiving and retaining member 24 received in the kerf 32 thereof and with the upper curtain wall member supported on the curtain wall supporting member 22. The latching member 36 is engaged with a lower curtain wall member 30 by positioning the locating and retaining member 44 thereof in the kerf 34 of the lower curtain wall member 30. The locating and retaining member 44 is flexibly retained in the kerf 44 by the quantity of silicone 45.

The lower curtain wall member 30 is then rotated inwardly toward the channel (bracket) 18 in the direction of the arrow 47. As the lower curtain wall member 30 rotates into position the arrow-shaped latch 42 of the latching member 36 rotates downwardly and moves past the locking member 26 of the channel (bracket) 18, thereby securing the lower curtain wall member 30 in place. Further inward movement of the lower curtain wall member 30 is prevented by engagement of the distal end of the latch 32 with the stop 28 of the channel (bracket) 18.

Foam tape 48 secured beneath the proximal end of the horizontally disposed member 38 compresses to allow the latching member 36 and the arrow-shaped latch 42 to rotate into the locking member 26 of the channel (bracket) 18. Once the latching member 36 is locked in place in the locking member 26, the foam tape 48 decompresses thereby holding the latching member 36 snugly against the support member 22 until the joint sealant 48 sets to permanently hold the latching member 36 in place.

Figure 4:
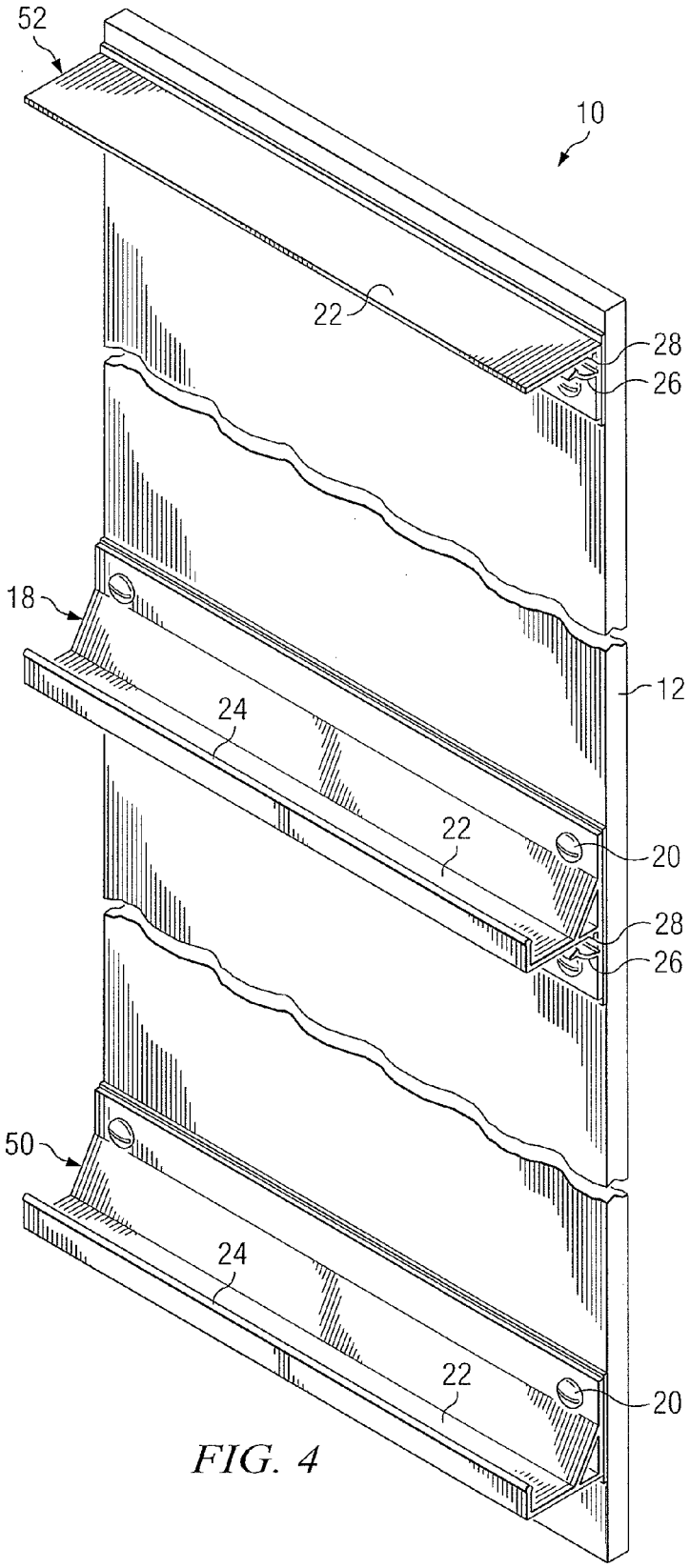
FIG. 4 is a perspective view illustrating an initial step in the utilization of the curtain wall installation method comprising the first embodiment of the first embodiment of the present invention.

FIG. 4 illustrates the preliminary step of the curtain wall installation method comprising the first embodiment of the present invention. Channels (brackets) 18 are secured to the wall 12 by suitable fasteners 20 at vertically spaced intervals substantially equal to the height of each wall member 30. At the base of the wall a bottom channel (bracket) 50 is mounted to receive a lower-most wall member 30 to be mounted on the wall 12. The bottom channel (bracket) 50 is substantially similar in construction to the channel (bracket) 18 but comprises only a support member 22 and a receiving and retaining member 24 on the distal end thereof. A top channel (bracket) 52 is mounted to receive the uppermost wall member 30 to be mounted on the wall 12. The top channel (bracket) 52 is similar in construction to the channel (bracket) 18 but comprises only a support member 22, a stop 28, and a locking member 26.

Figure 5:
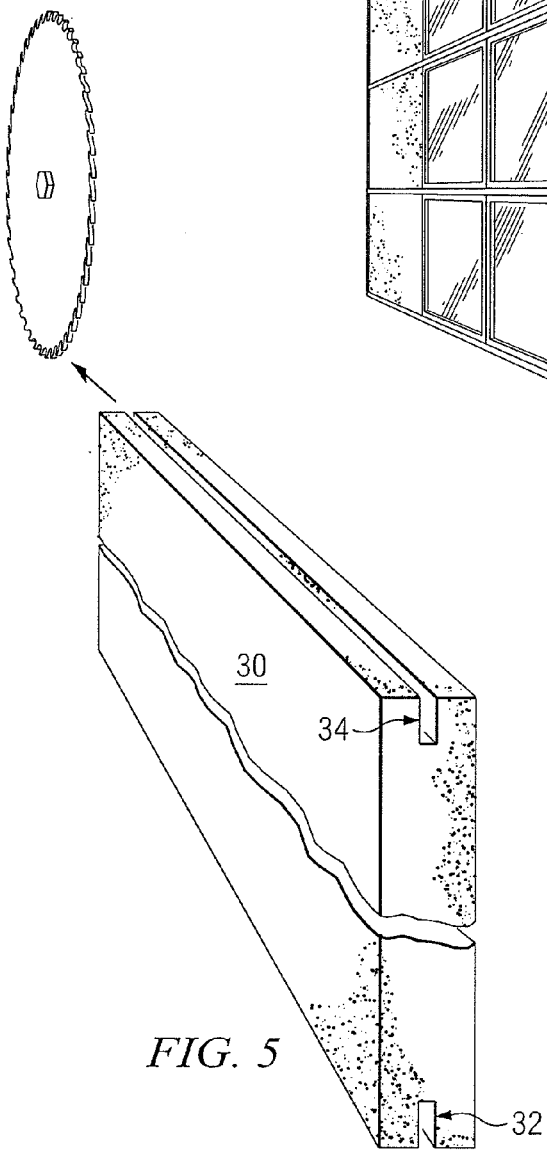
FIG. 5 is a perspective view illustrating a later step in the utilization of the curtain wall installation method comprising the first embodiment of the present invention.
Figure 6:
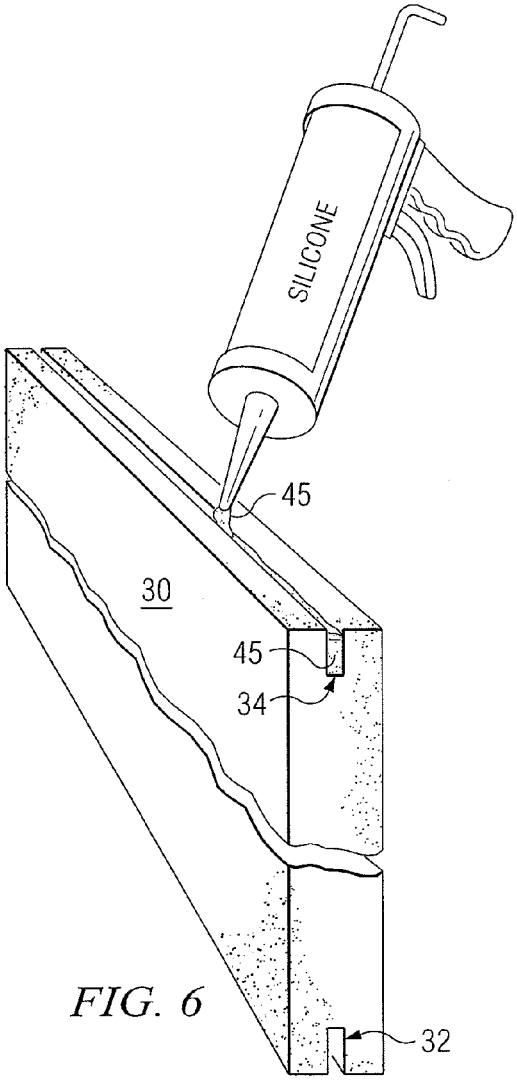
FIG. 6 is a perspective view illustrating a somewhat later step in the utilization of the curtain wall installation method comprising the first embodiment of the present invention.
Figure 7:
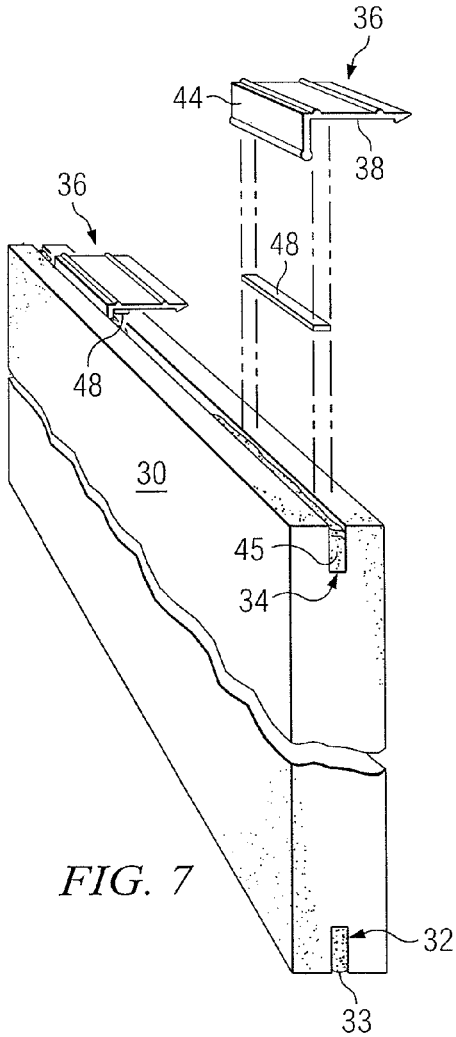
FIG. 7 is a perspective view illustrating a still later step in the utilization of the curtain wall installation method comprising the first embodiment of the present invention.

Referring now to FIGS. 5 through 7, there is shown the next steps in the curtain wall installation method comprising the first embodiment of the present invention which prepares the wall member 30 for mounting. As best shown in FIG. 5, kerfs 32 and 34 are formed in the lower and upper ends of the wall member 30. Silicone 45 is applied into the kerfs 34 as shown in FIG. 6, and silicone 33 is similarly applied into the kerfs 32. As best shown in FIG. 7, once the silicone is applied, foam tape 48 is secured below the distal end of the horizontally disposed portion 38 of the latching member 36 after which the locating and retaining member 44 is inserted into the kerf 32 in the upper end of the wall member 30. The locating and retaining member 36 is flexibly secured in the kerf 34 by the silicone received therein.

Figure 8:
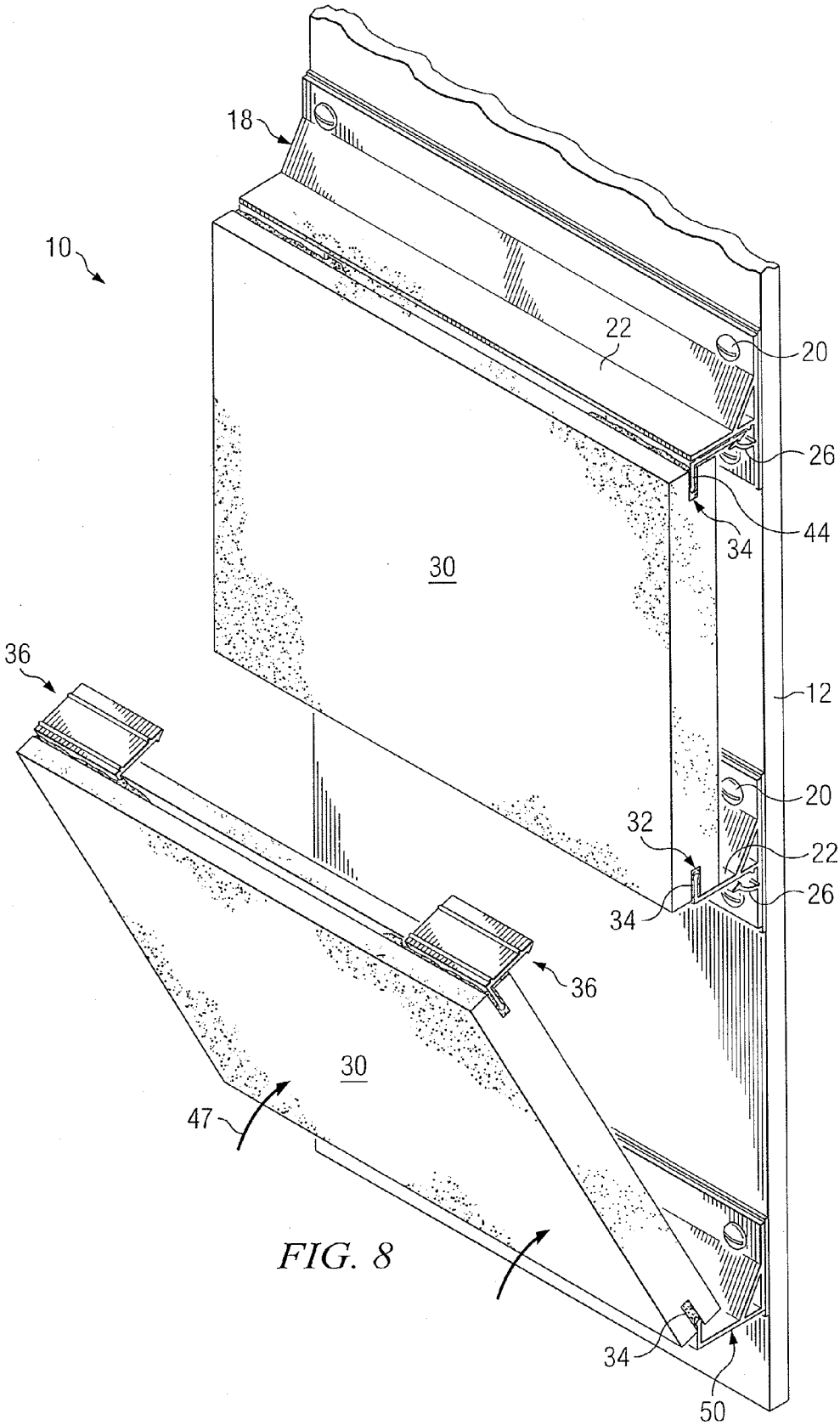
FIG. 8 is a perspective view illustrating an even later step in the utilization of the curtain wall installation method comprising the first embodiment of the present invention.
Figure 9:
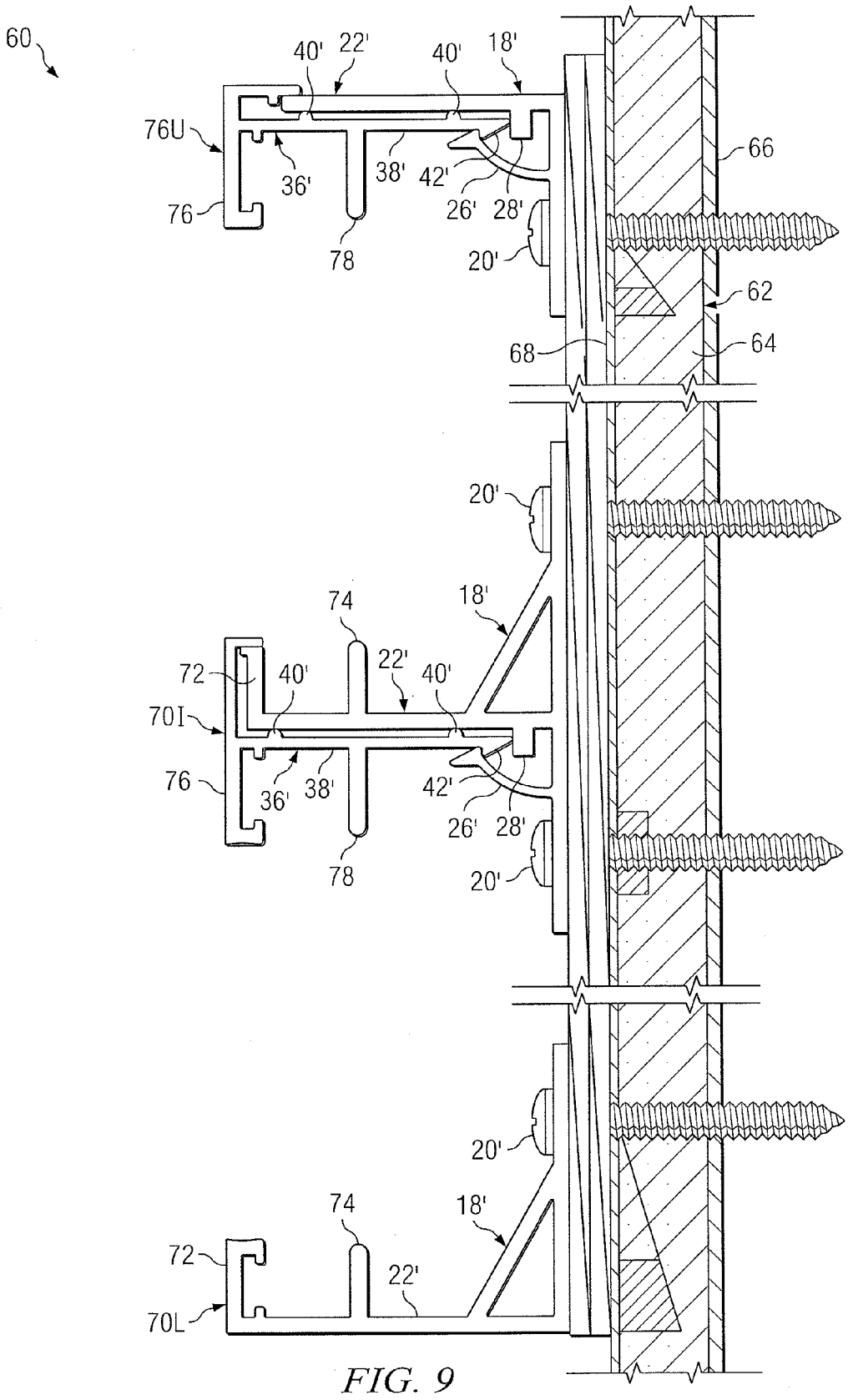
FIG. 9 is a sectional view illustrating a second embodiment of the present invention.

Referring now to FIG. 8, the wall members 30 are installed beginning at the top of the wall 12 and proceeding downward therefrom. Once the wall member 30 is prepared, the silicone filled kerf 34 at the lower end of a wall member 30 receives the receiving and retaining member 24 of the support member 22 located near the lower end of the wall member 30. The wall member 30 is then rotated inwardly toward the channel (bracket) 18 in the direction of the arrow 47. As the lower curtain wall member 30 rotates into position, the arrow-shaped latch 42 of the latching member 36 moves past the locking member 26 of the channel (bracket) 18 thereby securing the lower curtain wall member 30 in place. Once the curtain wall members 30 are in place an open cell backer rod 43 and then silicon sealant 46 are placed between the wall members 30.

The first embodiment of the present invention is illustrated in conjunction with the construction of curtain walls wherein the wall members 30 are formed of limestone, stone, and other like materials. However, the present invention is equally applicable to constructing walls comprising tile, porcelain, wood and various other materials used for wall curtains both on interior and exterior walls.

A curtain wall 60 comprising a second embodiment of the present invention is illustrated in FIGS. 9 through 12, inclusive. The curtain wall 60 includes various component parts which are substantially identical in construction and function to component parts of the curtain wall 10 illustrated in FIGS. 1 through 8 and described hereinabove in conjunction therewith. Such identical component parts are identified in FIGS. 9 through 12 with the same reference numerals utilized above in the description of the curtain wall 10. The curtain wall 60 differs from the curtain wall 10 in that the curtain wall 60 is designed and intended for use with relatively light weight curtain wall members fabricated from materials such as travertine stone, tile, composite materials, and the like.

The curtain wall 60 is supported on a wall 62 comprising a central core 64 and internal layer 66 and an external layer 68. The wall 62 may comprise an exterior walling of a building or other structure. In such instances, the wall 62 may be provided with a weather proof exterior layer which is fabricated in accordance with conventional techniques.

In accordance with the second embodiment of the present invention, a plurality of channels (brackets) 18' are secured to the wall 62 by suitable fasteners 20'. The channels (brackets) 18' may be fabricated from aluminum; however, other materials may be utilized in the fabrication of the channels (brackets) 18' depending upon the requirements of particular applications of the present invention. A plurality of channels (brackets) 18' may be positioned adjacent to one another to define a curtain wall support structure which extends substantially the entire width of the wall 62. Alternatively, channels (brackets) 18' may be positioned at spaced apart locations along the width of the wall 62.

The channels (brackets) 18' comprise three different types including a plurality of upper channels (brackets) 70U, a multiplicity of intermediate channels (brackets) 701, the exact number of which depends on the height of the curtain wall 60 and a plurality of lower channels (brackets) 70L. The intermediate channel (bracket) assembly 701 each includes a channel (bracket) 18' having a pair of curtain wall member locators 72 and 74 extending vertically upwardly from the supporting member 22'. The latching member 36' similarly has a pair of curtain wall member locators 76 and 78 which extend downwardly from the horizontally disposed portion 38' of the latching member 36'. The locating member 76 extends upwardly from the horizontally disposed portion 38' and over the top of the curtain wall member locator 72 of the channel (bracket) 18' to provide a pleasing appearance at the joints between adjacent curtain wall members.

The upper channels (brackets) 70U differ from the immediate channels (brackets) 701 in that the curtain wall member locators 72 and 74 are omitted and the upper portion of the curtain wall member locator 76 is configured to engage the distal end of the supporting member 22'. The lower curtain wall channels (brackets) 70L include the curtain wall member locators 72 and 74, but the components of the intermediate channels (brackets) 701 associated with the latching members 36' are omitted.

Figure 10:
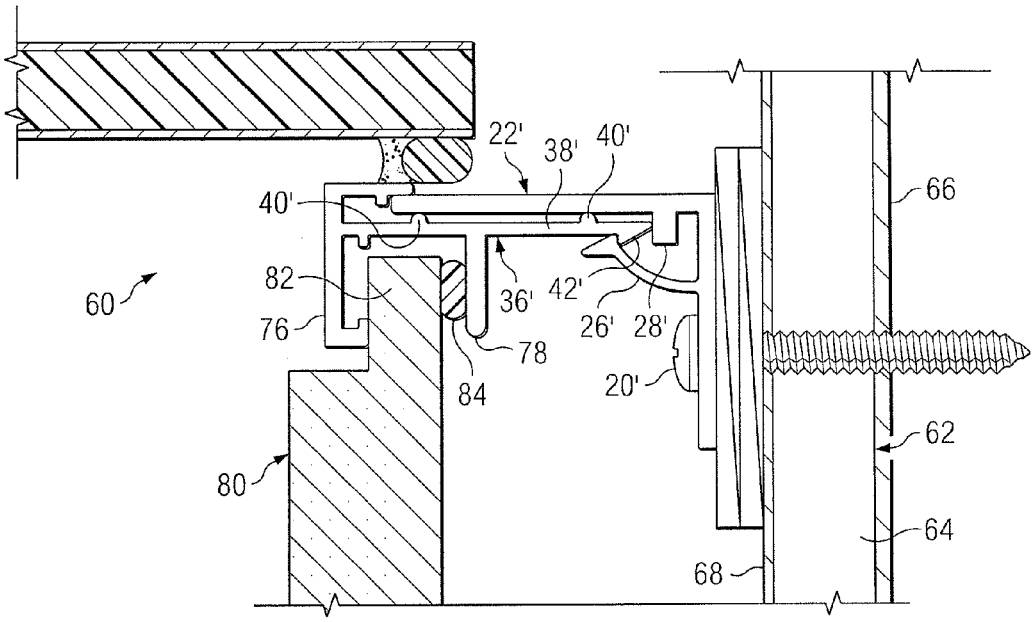
FIG. 10 is an enlargement of the upper portion of FIG. 9.
Figure 11:
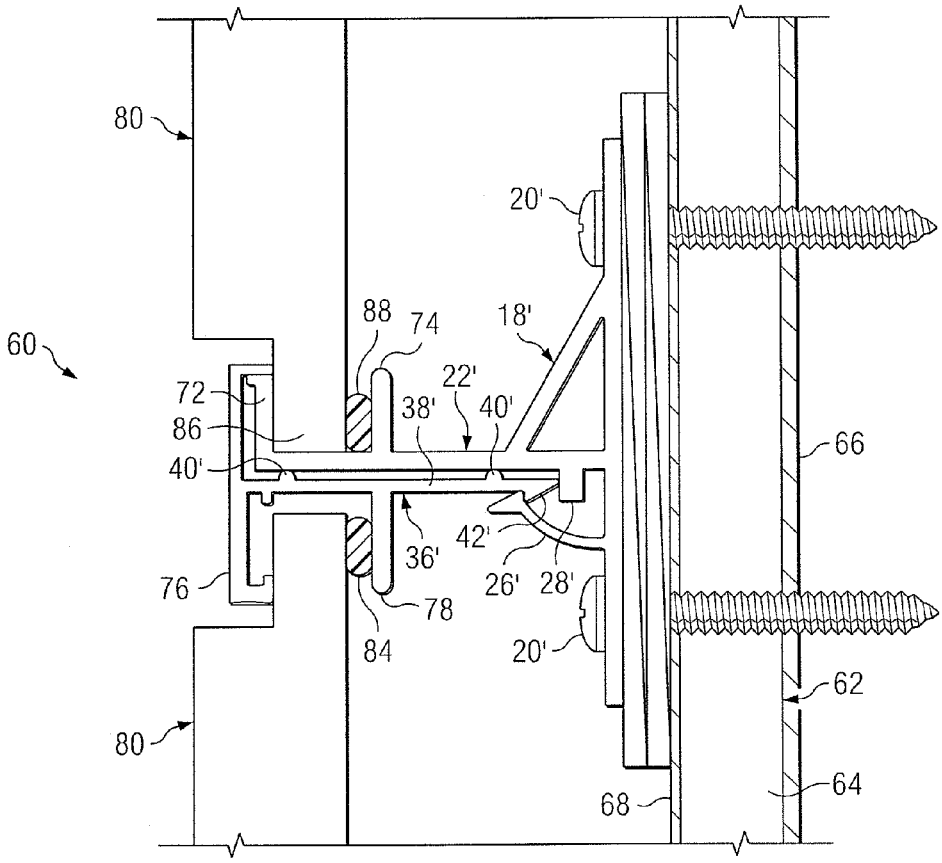
FIG. 11 is an enlargement of the intermediate portion of FIG. 9.
Figure 12:
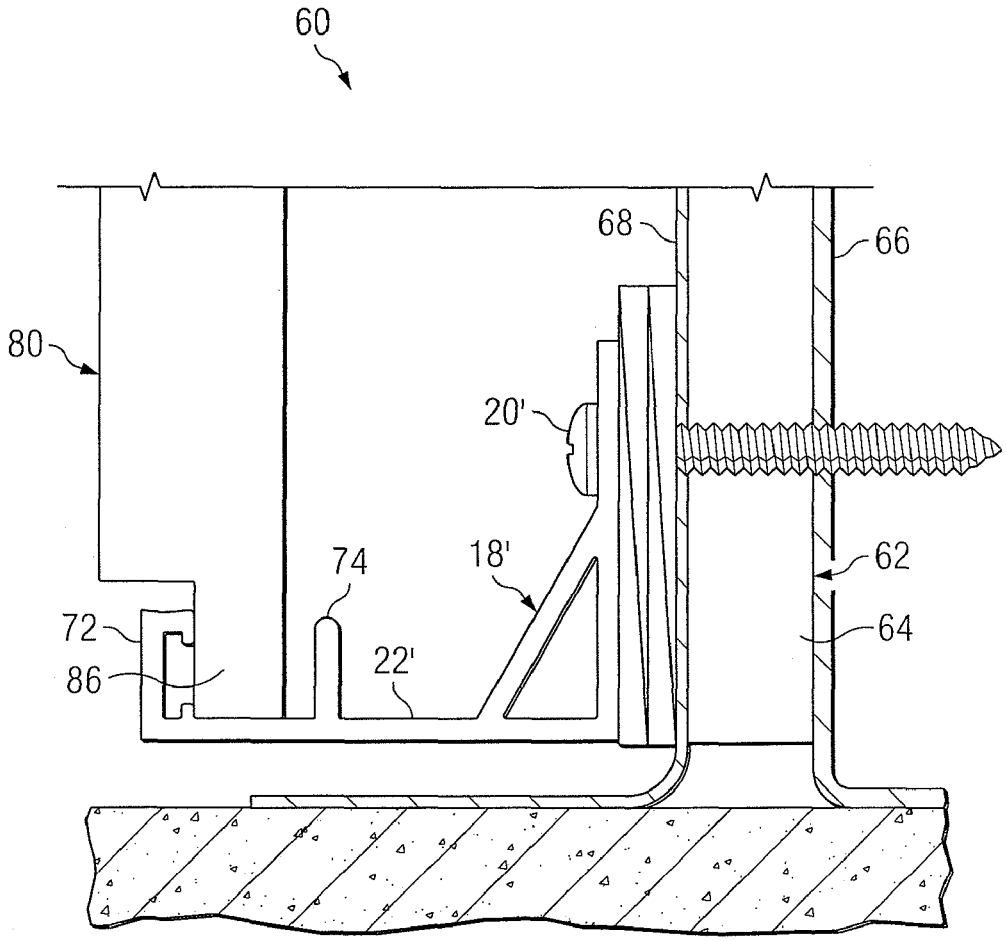
FIG. 12 is an enlargement of the lower portion of FIG. 9.

FIGS. 10, 11 and 12 illustrate the curtain wall system 60 having curtain wall members 80 installed therein. Each of the curtain wall members 80 has a relieved portion 82 at the upper end thereof which is received within and located by the locators 76 and 78 of the latching member 36'. A bead of silicone 84 is positioned between each relieved portion 82 and the locator 78 to secure the curtain wall member 80 against movement relative to locators 76 and 78. The lower end of each curtain wall member 80 is relieved at 86 and is received between the locators 72 and 74. A bead of silicone 88 is positioned between the lower relieved portion 82 of the curtain wall member 80 and the locator 74 to prevent movement of the curtain wall member 80 relative to the locators 72 and 74.

The curtain wall members 80 of the curtain wall system 60 are installed similarly to the installation of the curtain wall members 30 of the curtain wall system 10 as illustrated in FIG. 8 and described hereinabove and in conjunction therewith. The installation of each curtain wall member 80 begins with engagement of the lower relieved portion 86 between the locators 72 and 74 of one of the supporting members 22', it being understood that the silicone bead 88 is installed before the curtain wall member 80 is engaged between the locators 72 and 74. The relieved portion 82 at the upper end of the curtain wall member 80 receives the latching member 36' thereon, it being understood that the silicone bead 78 is installed prior to the installation of the curtain wall member 80.

After the relieved portion 86 has been engaged between the locators 72 and 74, the curtain wall member 80 is rotated inwardly toward the channel (bracket) 22'. As the curtain wall member 80 moves into position, the arrow-shaped latch 42' moves past the locking member 26' of the channel (bracket) 18', thereby securing the curtain wall member 80 in place. Before the curtain wall member 80 is secured in place, the silicone beads 78 and 88 are installed between the relieved portions 82 and 86 of the curtain wall member and the adjacent locators 76 and 78 and 72 and 74, respectively.

Figure 13:
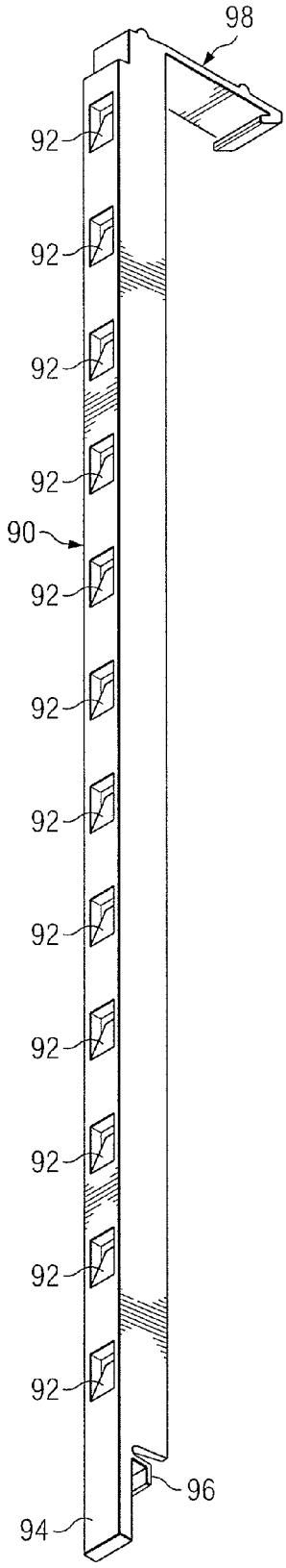
FIG. 13 is a perspective view illustrating a third embodiment of the present invention.
Figure 14:
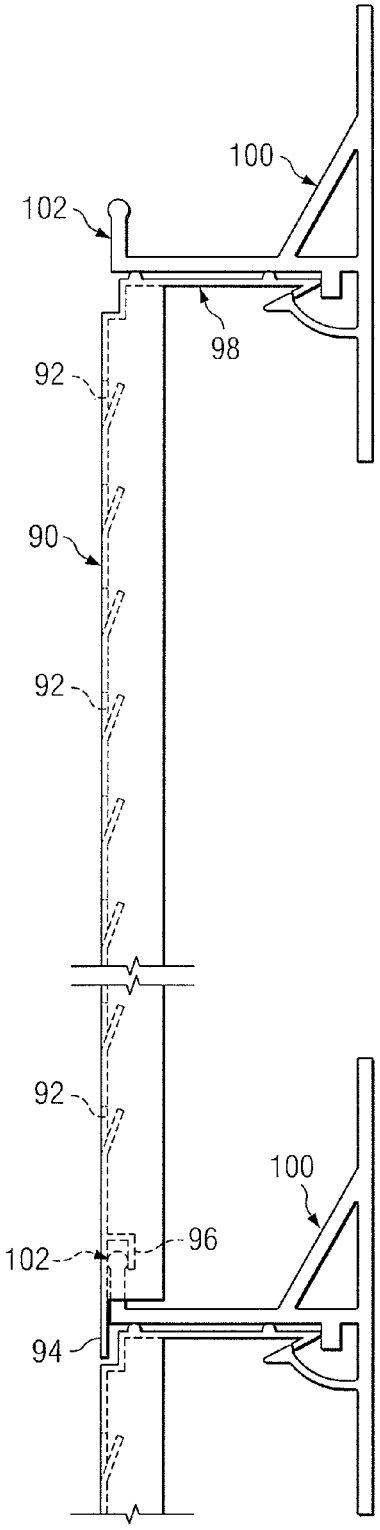
FIG. 14 is a side view further illustrating the third embodiment of the present invention.
Figure 15:
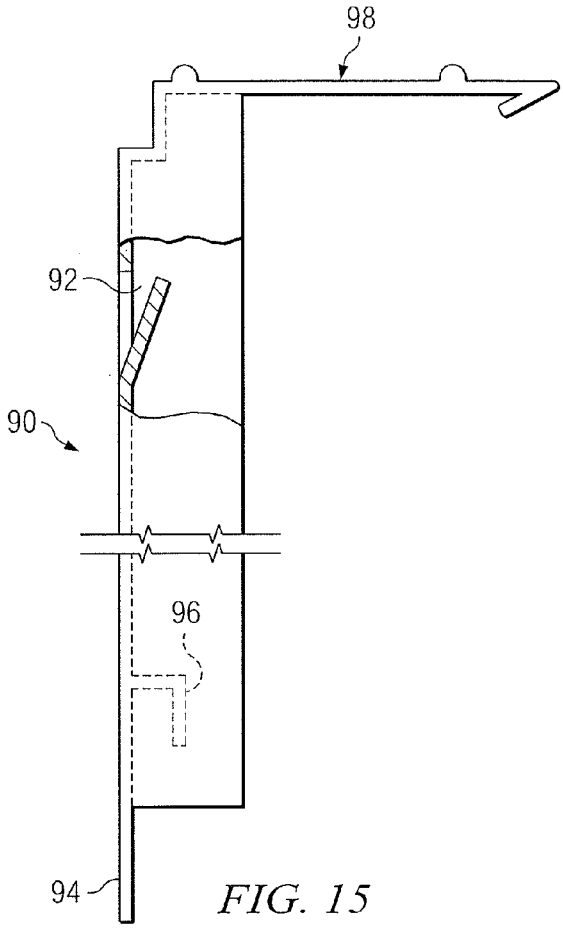
FIG. 15 is an enlargement of a portion of FIG. 14.

A third embodiment of the present invention comprising a system for closing the joints between adjacent curtain wall members is illustrated in FIGS. 13 through 15, inclusive. As is well-known current systems for filling the gaps between adjacent curtain wall members comprise use of either grout or plastic materials such as silicone. Utilization of either of the existing systems can result in difficulties caused by pressure differentiations on opposite sides of curtain wall members.

Referring particularly to FIG. 13 there is shown a mechanism for filling gaps between adjacent curtain wall billing members which eliminates the foregoing and other difficulties which have long since characterized the prior art. In accordance with the third embodiment of the present invention, a gap filling member 90 formed from a suitable plastic material is provided with a plurality of vents 92 which eliminate the possibility of pressure differentiation on opposite sides of a curtain wall member.

The lower end of the gap filling member 90 includes an extension 94 useful in hiding horizontal gaps which would otherwise be readily observable when gap filling members 90 are positioned one above the other. The lower end of the gap filling member 90 further includes a hook 96 useful in securing the gap filling member 90 against dislocation. The upper end of the gap filling member 90 comprises a latching member 98 which is substantially identical in construction and function to the latching members 36 and 36' described hereinabove in connection with the curtain wall members 30 and 80.

Referring to FIG. 14, receiving and supporting members 100, which are substantially identical in construction and function to the receiving members 22 and 22' described hereinabove and in conjunction with the first and second embodiments of the present invention include a vertically extending retainer 102. The retainer 102 receives the hook 96 of the gap filling member 90, thereby supporting the weight of the gap filling member 90.

The gap filling member 90 is installed between adjacent curtain wall members by first engaging the hook 96 thereof with an appropriate retainer 102. The gap filling member 90 is then rotated inwardly toward the supporting and positioning member 100 as gap filling member 90 moves into position the arrow-shaped latch at the distal end of the latching member 104 moves past the locking member of the receiving and supporting member 100 thereby securing the gap filling member 90 in place. As pointed out above, the vents 92 of the gap filling member 90 eliminate pressure differentiation on opposite sides of the curtain wall members which extend adjacent to the gap filling member 90.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. A method, comprising:

substantially filling first and second kerfs of a curtain wall member with joint sealant, the first and 12 kerfs in upper and lower ends, respectively, of the curtain wall member;

embedding a locating-and-retaining member of a latching member in the joint sealant in the first kerf, the latching member comprising a nominally horizontally-disposed portion having first and second ends, the locating-and-retaining member located at the first end of the horizontally-disposed portion and extending downwardly with respect to the horizontally-disposed portion, the horizontally-disposed portion of the latching member positioned such that foam tape beneath the horizontally-disposed portion is positioned in engagement with the upper end of the curtain wall member;

embedding a receiving-and-retaining member of a first bracket in the joint sealant in the second kerf such that the curtain wall member initially extends upwardly and angularly outwardly relative to the first bracket, a second bracket positioned above and substantially parallel to the first bracket; and pivoting the curtain wall member inwardly toward the second bracket such that the second end of the horizontally-disposed portion of the latching member slides along a lower surface of a supporting member of the second bracket causing the latching member to rotate downwardly, compressing the foam tape, the second end of the latching member sliding along the lower surface of the second bracket moving past a locking member disposed beneath the lower surface of the supporting member of the second bracket until a latch at the second end of the latching member comes into latching engagement with the locking member, the foam tape beneath the horizontally-disposed portion of the latching member decompressing once the latch comes into latching engagement with the locking member and maintaining the latching member in engagement with the lower surface of the supporting member of the second bracket to facilitate holding the latching member in place.

2. The method of claim 1, comprising rotating the latching member such that the latch of the latching member comes out of latching engagement with the locking member disposed beneath the lower surface of the supporting member, the latching member compressing the foam tape, the second end of the latching member adapted to slide along the lower surface of the second bracket moving outward past the locking member until the latching member is released.

3. The method of claim 1, wherein:

the first and second brackets are part of a plurality of brackets comprising at least one additional bracket and being secured to a wall at vertically spaced intervals, the brackets of the plurality of brackets being substantially parallel to one another; and the curtain wall member is one of a plurality of curtain wall members all substantially equal in height.

4. The method of claim 3, wherein a bracket in the plurality of brackets comprises a top bracket, the top bracket comprising a stop, for receiving an upper-level curtain wall member, and a locking member.

5. The method of claim 3, wherein a bracket in the plurality of brackets comprises a bottom bracket, the bottom bracket comprising a supporting member and a receiving-and-retaining member and being adapted to receive a lower level curtain wall member.

6. The method of claim 1, wherein the second bracket is separated from the first bracket by a distance substantially equal to the height of the curtain wall member.

7. The method of claim 1, wherein the receiving-and-retaining member of the first bracket is located at and extends vertically upward from the first end of the supporting member of the first bracket.

8. The method of claim 1, comprising mounting the first and second brackets directly to a wall of a structure.

9. The method of claim 1, wherein the first and second brackets are secured to a wall of a structure with one or more intervening layers of material between the first and second brackets and the wall.

10. The method of claim 1, wherein the foam tape, after decompressing once the latch comes into latching engagement with the locking member, maintains the latching member in engagement with the lower surface of the supporting member of the second bracket at least until the joint sealant in the first kerf sets to hold the latching member in place.

11. A curtain wall system, comprising:

a curtain wall member comprising:

first and second kerfs in upper and lower ends, respectively, of the curtain wall member; and a latching member comprising a locating-and-retaining member, a nominally horizontally-disposed portion, and a latch, the locating-and-retaining member embedded in joint sealant in the first kerf, the locating-and-retaining member located at a first end of the horizontally disposed portion and extending downwardly with respect to the horizontally-disposed portion the horizontally-disposed portion of the latching member positioned such that foam tape beneath the horizontally-disposed portion is positioned in engagement with the upper end of the curtain wall member, the latch located at a second end of the horizontally-disposed portion; and first and second brackets, the first bracket comprising a receiving-and-retaining member embedded in joint sealant in the second kerf such that during installation of the curtain wall member, the curtain wall member initially extends upwardly and angularly outwardly relative to the first bracket, the second bracket positioned above and substantially parallel to the first bracket;

the curtain wall member adapted to be pivoted inwardly, during installation, toward the second bracket such that the second end of the horizontally-disposed portion of the latching member slides along a lower surface of a supporting member of the second bracket causing the latching member to rotate downwardly, compressing the foam tape, the second end of the latching member sliding along the lower surface of the second bracket moving past a locking member disposed beneath the lower surface of the supporting member of the second bracket until a latch at the second end of the latching member comes into latching engagement with the locking member, the foam tape beneath the horizontally-disposed portion of the latching member decompressing once the latch comes into latching engagement with the locking member and maintaining the latching member in engagement with the lower surface of the supporting member of the second bracket to facilitate holding the latching member in place.

12. The curtain wall system of claim 11, wherein the latching member is adapted to be rotated such that the latch of the latching member comes out of latching engagement with the locking member disposed beneath the lower surface of the supporting member, the latching member compressing the foam tape, the second end of the latching member adapted to slide along the lower surface of the second bracket moving outward past the locking member until the latching member is released.

13. The curtain wall system of claim 11, wherein:

the first and second brackets are part of a plurality of brackets comprising at least one additional bracket and being secured to a wall at vertically spaced intervals, the brackets of the plurality of brackets being substantially parallel to one another; and the curtain wall member is one of a plurality of curtain wall members all substantially equal in height.

14. The curtain wall system of claim 13, wherein a bracket in the plurality of brackets comprises a top bracket, the top bracket comprising a a stop, for receiving an upper-level curtain wall member, and a locking member.

15. The curtain wall system of claim 13, wherein a bracket in the plurality of brackets comprises a bottom bracket, the bottom bracket comprising a supporting member and a receiving-and-retaining member and being adapted to receive a lower level curtain wall member.

16. The curtain wall system of claim 11, wherein the second bracket is separated from the first bracket by a distance substantially equal to the height of the curtain wall member.

17. The curtain wall system of claim 11, wherein the receiving-and-retaining member of the first bracket is located at and extends vertically upward from the first end of the supporting member of the first bracket.

18. The curtain wall system of claim 11, wherein the first and second brackets are adapted to mount directly to a wall of a structure.

19. The curtain wall system of claim 11, wherein the first and second brackets are adapted to be secured to a wall of a structure with one or more intervening layers of material between the first and second brackets and the wall.

20. The curtain wall system of claim 11, wherein the foam tape, after decompressing once the latch comes into latching engagement with the locking member, maintains the latching member in engagement with the lower surface of the supporting member of the second bracket at least until the joint sealant in the first kerf sets to hold the latching member in place.

* * * * *